US010633216B2

(12) United States Patent
Tamamian

(10) Patent No.: US 10,633,216 B2
(45) Date of Patent: Apr. 28, 2020

(54) EARPHONE CABLE HOLDER

(71) Applicant: Kegham Tamamian, Tuckahoe, NY (US)

(72) Inventor: Kegham Tamamian, Tuckahoe, NY (US)

( * ) Notice: Subject to any disclaimer, the term of this patent is extended or adjusted under 35 U.S.C. 154(b) by 133 days.

(21) Appl. No.: 15/863,424

(22) Filed: Jan. 5, 2018

(65) Prior Publication Data

US 2018/0194591 A1 Jul. 12, 2018

Related U.S. Application Data

(60) Provisional application No. 62/443,084, filed on Jan. 6, 2017.

(51) Int. Cl.

| | |
|---|---|
| ***H04R 1/10*** | (2006.01) |
| ***B65H 75/40*** | (2006.01) |
| ***B65H 75/28*** | (2006.01) |
| ***B65H 75/36*** | (2006.01) |
| ***H04R 5/033*** | (2006.01) |

(52) U.S. Cl.

CPC ..... *B65H 75/406* (2013.01); *B65H 75/28* (2013.01); *B65H 75/36* (2013.01); *H04R 1/1016* (2013.01); *H04R 1/1033* (2013.01); *H04R 5/033* (2013.01); *B65H 2701/3919* (2013.01); *H04R 2201/023* (2013.01); *H04R 2499/11* (2013.01)

(58) Field of Classification Search

CPC .. H04R 1/1008; H04R 1/1016; H04R 1/1033; H04R 1/1058; H04R 5/033; H04R 2201/023; H04R 2499/11; H04M 1/05

USPC ..... 381/309, 370, 374, 376, 380, 384; 379/430, 438; 181/129, 130, 135

See application file for complete search history.

(56) References Cited

U.S. PATENT DOCUMENTS

| | | | | |
|---|---|---|---|---|
| 7,974,432 | B1 * | 7/2011 | Ryan | A42B 1/245 2/195.1 |
| 8,311,257 | B2 * | 11/2012 | Hu | H04R 1/1066 381/301 |
| 8,798,305 | B2 * | 8/2014 | Harper | H04R 1/1016 381/374 |
| 9,797,420 | B2 | 10/2017 | Vecchione | |

(Continued)

OTHER PUBLICATIONS

Gwee Sport Guppy, available from http://www.gwee.com, 2015.

*Primary Examiner* — Huyen D Le

(57) ABSTRACT

An earphone cable holder comprises a base having a first end portion, a second end portion, and a central portion, wherein the central portion is sufficiently flexible that the first end portion can be folded over the second end portion and wherein the central portion is sufficiently wide and sufficiently rigid to allow an earphone cable to be wound around it. The earphone cable holder further comprises a magnet on the first end portion and a material on the second end portion that is attracted to the magnet. A cable connecting mechanism is positioned on the central portion. In use, an earphone cable may be connected to the cable connecting mechanism and the first end portion and the second end portion may clasp onto a material positioned therebetween by magnetic attraction. In another version, a material on the central portion exerts a grabbing effect on a cable passing through the central portion. The earphone cable holder may also include a decorative member on which a decorative feature can be displayed.

14 Claims, 5 Drawing Sheets

(56) References Cited

U.S. PATENT DOCUMENTS

| | | | | |
|---|---|---|---|---|
| 2006/0251283 | A1* | 11/2006 | Yeh | H04R 1/1033<br>381/388 |
| 2007/0291974 | A1* | 12/2007 | Eisenbraun | H04R 1/1016<br>381/370 |
| 2009/0016559 | A1* | 1/2009 | Cleary | H04R 1/1091<br>381/375 |
| 2011/0317865 | A1* | 12/2011 | Stevinson | H04R 1/1033<br>381/384 |

* cited by examiner

EARPHONE CABLE HOLDER

PRIORITY

The present application claims the benefit of domestic priority based on United States Provisional Patent Application 62/443,084 filed on Jan. 6, 2017, the entirety of which is incorporated herein by reference.

BACKGROUND

With the proliferation of hand-held phones and music players, the transmission of sounds to the user has taken on important significance. While smart phones and music players may be able to store and play high quality recordings, a speaker system is necessary for the delivery of the sound to the user.

Numerous earphones designs are being widely used with mobile music players and mobile phones. While earphones are easy to use, their cables are often difficult and cumbersome to manage. Anyone who used earphones knows that the cables are often longer than the length needed by the user, and that they swing freely and inconveniently when the user moves, walks, or runs. In addition, the cable may sometimes get caught in various objects, and/or the earphones may fall down from the user's ear and get lost, scratched, or damaged. Moreover and usually most infuriatingly, when users try to retrieve their earphones from where they left them, they often find the cable entangled.

Many devices were developed to overcome some of these problems. There are devices for attaching an earphone cable to a garment, devices for packing earphone sets, and devices for winding an earphone cable. However, these devices have proven to be inadequate. Furthermore, the heretofore attempts have yet to provide a unique and simple solution to all the above-mentioned problems at once.

Therefore, there is a need for an earphone cable holder that can easily and simply attach to a garment. There is a further need for an earphone cable holder that can pack an earphone set. There is yet a further need for an earphone cable holder that can wind a cable in an improved manner. There is yet a further need for an earphone cable holder than can accomplish all of these needs.

SUMMARY

The present invention satisfies these needs. In one aspect of the invention, an earphone cable holder is provided that provides for simple and convenient attachment to a garment.

In another aspect of the invention, an earphone cable holder comprises a base having a first end portion, a second end portion, and a central portion, wherein the central portion is sufficiently flexible that the first end portion can be folded over the second end portion and wherein the central portion is sufficiently wide and sufficiently rigid to allow an earphone cable to be wound around it. The earphone cable holder further comprises a magnet on the first end portion and a material on the second end portion that is attracted to the magnet. A a cable connecting mechanism is provided on the central portion. An earphone cable may be connected to the cable connecting mechanism, and the first end portion and the second end portion may clasp onto a material positioned therebetween by magnetic attraction.

In another aspect of the invention, an earphone cable holder comprises a base having a first end portion, a second end portion, and a central portion, wherein the central portion is sufficiently flexible that the first end portion can be folded over the second end portion; a magnet on the first end portion; a material on the second end portion that is attracted to the magnet; and a material on the central portion that exerts a grabbing effect on a cable passing through the central portion when the first end portion is folded over the second end portion; wherein an earphone cable may be received within the central portion and wherein the first end portion and the second end portion may clasp onto a material positioned therebetween by magnetic attraction.

In another aspect of the invention, an earphone cable holder comprises a base having a first end portion, a second end portion, and a central portion, wherein the central portion is sufficiently flexible that the first end portion can be folded over the second end portion; a magnet on the first end portion; a material on the second end portion that is attracted to the magnet; a cable connecting mechanism on the central portion; and a decorative member on which a decorative feature can be displayed, the decorative member being selectively attachable to the earphone cable holder, wherein an earphone cable may be connected to the cable connecting mechanism and wherein the first end portion and the second end portion may clasp onto a material positioned therebetween by magnetic attraction.

In another aspect of the invention, a method of holding an earphone cable comprises providing a base having a first end portion, a second end portion, and a central portion; connecting an earphone cable to the central portion; winding the earphone cable around the central portion; folding the first end portion over the second end portion by flexing the central portion; and clasping onto a material positioned between the first end portion and the second end portion by magnetic attraction.

DRAWINGS

These features, aspects, and advantages of the present invention will become better understood with regard to the following description, appended claims, and accompanying drawings which illustrate exemplary features of the invention. However, it is to be understood that each of the features can be used in the invention in general, not merely in the context of the particular drawings, and the invention includes any combination of these features, where:

DESCRIPTION

The present invention relates to an earphone cable holder. In particular, the invention relates to an earphone cable holder that is attachable to apparel or other material by magnetic attraction. Although the invention is illustrated and described in the context of being useful for holding earphone cables, the present invention can be used in other ways, as would be readily apparent to those of ordinary skill in the art. Accordingly, the present invention should not be limited just to the examples and embodiments described herein. In this Application "earphone" or "earphones" or "earphone set" and all similar wordings include all or some of the following: earpieces, such as earbuds, canal-phones, and the like. The earphone cable includes the cable, the plug, the earpiece, and any other parts that are on the cable, such as the microphone, the control button, and the like.

Figure 1A:
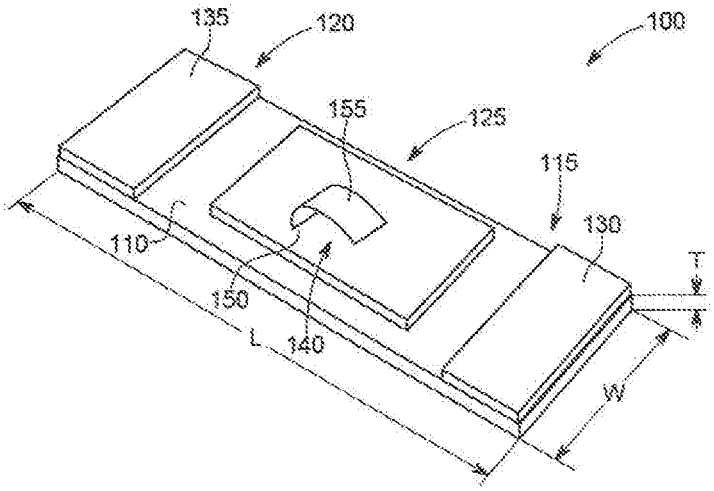
FIG. 1A is a schematic perspective view of an earphone cable holder according to one version of the invention.
Figure 1B:
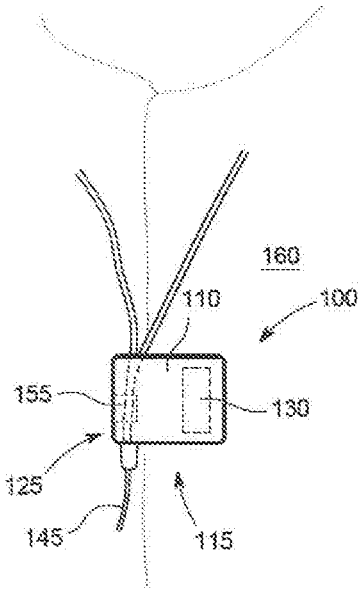
FIG. 1B is a schematic view of the earphone cable holder of FIG. 1A in use.

An earphone cable holder 100 according to one version of the invention is shown in FIG. 1A in the form of a wearable magnetic clip or clasp. The earphone cable holder includes a base 110 made up of a strip of material, such as leather, plastic, rubber, neoprene, and other flexible, semi-rigid, and rigid materials, and the like. The base 110 has a length, L, a width, W, and a thickness, T, as will be discussed. The base also has a first end portion 115, second end portion 120, and a central portion 125. The base 110 is sufficiently flexible, at least at the central portion 125, that the first end portion 115 may be folded over the second end portion 120 like a book with the fold occurring along the central portion 125, as shown in FIG. 1B. A first magnet 130 is provided on the first end portion 115, and a second magnet 135 is provided on the second end portion 120. The first magnet 130 and second magnet 135 are oppositely polarized so to as to attract one another when the first end portion 115 is folded over the second end portion 120. The attraction between the magnets serves to securely maintain the earphone cable holder 100 in a folded configuration until a separation force strong enough to overcome the attractive force is applied. Alternatively, one of the magnets 130, 135 can be replaced with a ferromagnetic material, such as a material containing iron, nickel, and/or cobalt. However, a stronger magnetic attraction force can be obtained when two magnets are utilized.

As shown in FIG. 1A, the first magnet 130 and the second magnet 135 are each shown as a single magnet. However, the first magnet 130 may comprise one or more magnets, and the second magnet may comprise one or more magnets. For example, in one version, the first magnet 130 can be made up of two or more magnets spaced along the width of the base 110. In this version, the second magnet 135 can also be made up of two or more magnets spaced along the width that correspond in position with the two magnets of the first magnet 130. In another version, the first magnet 130 can be made up of two or more strip magnets spaced along the length of the base 110, and the second magnet 135 can be made correspondingly. In yet another version, the first magnet 130 and the second magnet 135 can each be an array of magnets made up of one or more rows of magnets and one or more columns of magnets. And in yet another version, the first magnet 130 and the second magnet 135 can each be made up of a plurality of magnets positioned in no particular pattern but in corresponding position when the base 110 is in the folded position.

The central portion 125 of the base 100 of the earphone cable holder 100 is equipped with a cable connecting mechanism 140 for securing the earphone cable holder 100 to an earphone cable 145. The cable connecting mechanism 140 includes a passageway 150 through which an earphone cable 145 may pass. In the version of FIG. 1A, the cable connection mechanism includes one or more strips 155 or cords of material that are attached to the body 110 at opposite ends to create the passageway 150 between the ends. In one version, the strip 155 is elastic so that it can be stretched to increase the size of the passageway 150 so that the earphone cable 145 can be inserted therethrough. The elastic material of the strip 155 can then compress to hold the earphone cable within the passageway 150. In another version, the strip 155 may be disconnectable from the body 110 at one end to allow access to the passageway 150 and then reconnected after the earphone cable 145 is positioned in the passageway 150. This can be accomplished with any type of connection/disconnection mechanism, such as a clip, button, hook and loop fastener, such as Velcro, and the like. Alternatively, the cable connecting mechanism 140 may be a hook and/or string, clip, ring, or the like. In another version, the cable connecting mechanism 140 can be one or more holes in the base 110 through which the cable 145 may pass.

FIG. 1B shows the earphone cable holder 100 in use. An earphone cable 145 is positioned within the passageway 150 of the cable connecting mechanism 140, and the first end portion 115 is folded over the second end portion 120 so that the first magnet 130 magnetically engages the second magnet 135. The earphone cable holder 100 can then be used as to clasp onto an article of clothing or other item. For example, as shown in FIG. 1A, the earphone cable holder 100 can be clasped onto a shirt 160 by inserting material of the shirt 160, such as a shirt placket, between the magnets 130, 135. The magnets 130, 135 are of sufficient strength to maintain the attractive force even with an intermediary piece of material. With the earphone cable conveniently clasped to a user's shirt or other piece of apparel, the user can easily don and doff the earphones while managing the cable in an unencumbering fashion.

Figure 2:
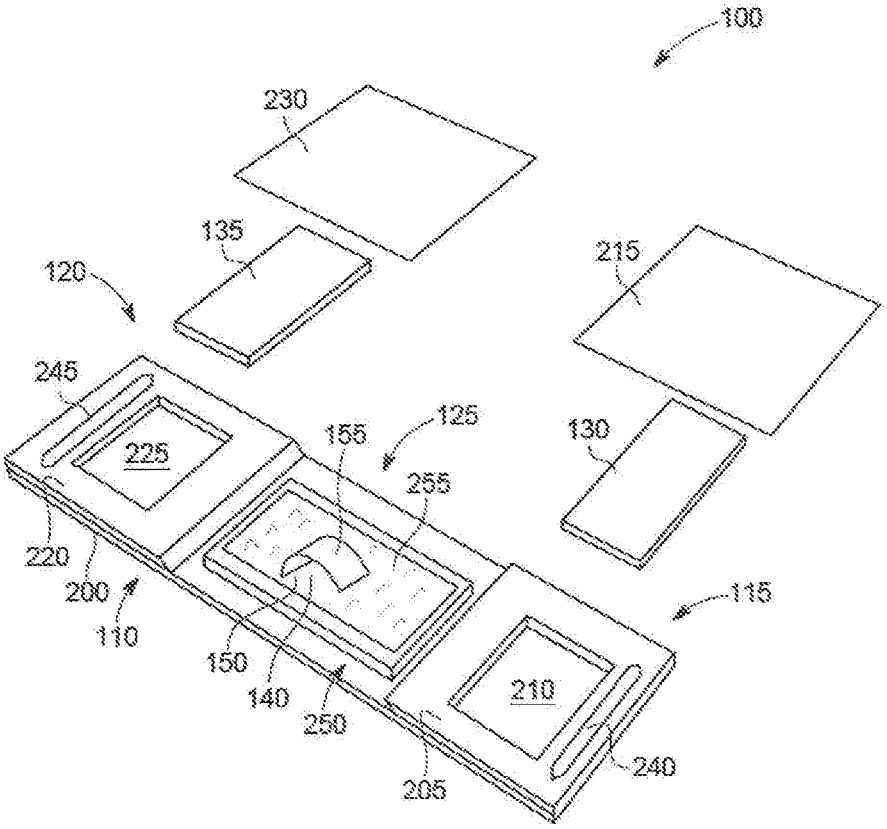
FIG. 2 is an exploded perspective view of another version of an earphone cable holder according to the invention.

FIG. 2 shows an exploded view of a particular version of an earphone cable holder 100 according to one version of the invention. The base 100 is made up of a rectangular strip 200 of material, such as leather or the like. At the first end portion 115 of the base 110, a first layer of material 205 is attached to the rectangular strip 200. The first layer of material 205 may be the same or different material as the rectangular strip 200. The first layer of material 205 includes a cavity 210 into which the first magnet 130 may be received. A first top layer 215 may then be placed on top of the first layer of material 205 and the first magnet 130 in the cavity 210 so that the first magnet 130 and the first layer of material 205 are sandwiched between the rectangular strip 200 and the first top layer 215. The first top layer 215 may be made up of the same or different material as the rectangular strip 200 and/or the first layer of material. In similar manner, the second end portion 120 of the base 110 has a second layer of material 220 attached to the rectangular strip 200. The second layer of material 220 includes a cavity 225 for receiving the second magnet 135 on top of which may be installed a second top layer 230. In one version, the rectangular strip 200, the first and second layers of material 205,220, and the first and second top layers 215, 230 are all made of leather. In one particular version, the top layers 215, 230 are thinner than the rectangular strip 200 and/or the first and second layers of material 205, 220. In this version, the first magnet 130 and the second magnet 135 are sufficiently strong to maintain an attractive force though the first and second top layers 215, 230 and through any materials positioned between the first end portion 115 and the second end portion 120 when the earphone cable holder is in its folded and clasping configuration.

The first magnet 130 and second magnet 135 may be secured within the cavities 210, 225 in any suitable manner. For example, the magnets 130, 135 may be attached by adhesive, such as a glue, cement, or epoxy, to the base 110 and/or first layer 205, 220 and/or top layer 215, 230. Alternatively, the magnets 130, 135 may be inserted within the layers during the manufacturing process, such as by injection molding a plastic material around the magnets 130, 135 after they are placed in the mold.

The earphone cable holder 100 may include additional features for maintaining the clasping configuration. For example, as shown in FIG. 2, the first end portion 115 may include a protuberance 240 that can be received within a depression 245 on the second end portion 120. The protuberance 240 fits inside the depression 245 in a manner that prevents sliding of the first end portion 115 relative to the second end portion 120 when the portions are folded on top of one another. Thus, the magnets 130, 135 cannot be separated by sliding but instead can only be separated by applying a sufficiently strong separation force.

In one version of the invention, as also shown in FIG. 2, near the cable connecting mechanism 150, the central portion 125 of the earphone cable holder 100 may include a carpet 250. The carpet 250 exerts a grabbing effect on an earphone cable 145 passing through the central portion 125. The carpet 250 applies pressure to the earphone cable 145 when the first end portion 115 is folded over the second end portion 120 and holds the earphone cable 145 in place by a combination of friction and compression. This grabbing effect is sufficient to counteract the force of gravity and to keep the earphone cable 145 in place until a stronger force is applied. The carpet 250 may be composed of any material that performs the function. In one version, the carpet 250 comprises a material that has a higher coefficient of friction than the material of the base 110. In another version, the carpet 250 comprises a material that is more easily compressed that the material of the base 110. For example, the carpet 250 may comprise one or more of a furry, plushy, shaggy, fleecy, wooly or fluffy texture, such as real or fake fur or sheep skin, or synthetic fluffy fabric, and the like. In one particular version, the carpet 250 comprises faux fur 255. The carpet 250 may be used to complement the cable connecting mechanism 155 or may be used in place of it.

In an alternative version of the earphone cable holder 100, the base 110 may be made of one or more other materials. For example, the base 110 may comprise one or more layers of any foldable material. In one version, the base 100 comprises a soft and flexible fabric attached to a stiffening element, such as a plastic strip or flexible metal or the like. In another version, the base 110 comprises a combination of rigid materials and flexible materials with the folding portion being made of the flexible material. Alternatively, rigid sections can be connected by a hinge, joints, rings, or the like. In yet another version, the edges of the base 110 or other parts may be cut in different patterns, such as zigzag or half circles or any other pattern. The inner and outer surfaces of the earphone cable holder 100 may be any color and may be embroidered or have various prints, drawings, symbols, logos, designs, carvings, or the like. The extremities of the first and second end portions 115, 120 may be any of various shapes, such as circular, semi-circular, star, semi-star, rectangular, triangular, or the shape of an object, such as a symbol, animal, or flower.

Figure 3A:
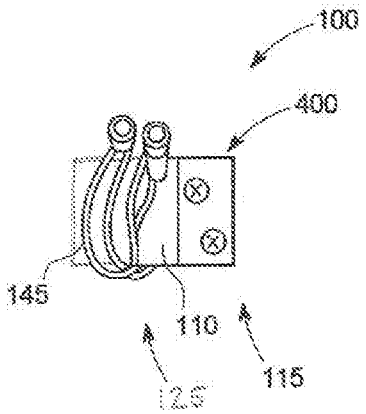
FIG. 3A is a schematic view of the earphone cable holder of FIG. 2 in use.
Figure 3B:
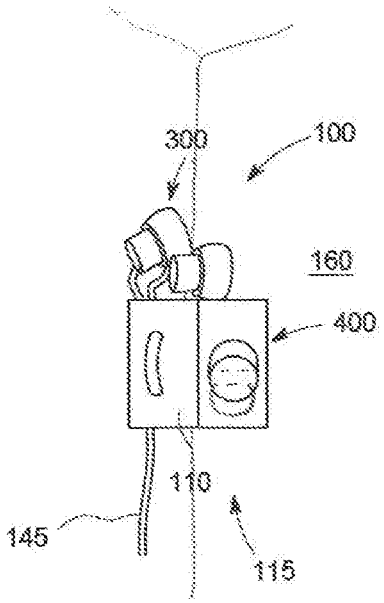
FIG. 3B is a schematic view of the earphone cable holder of FIG. 2 in another use.
Figure 3C:
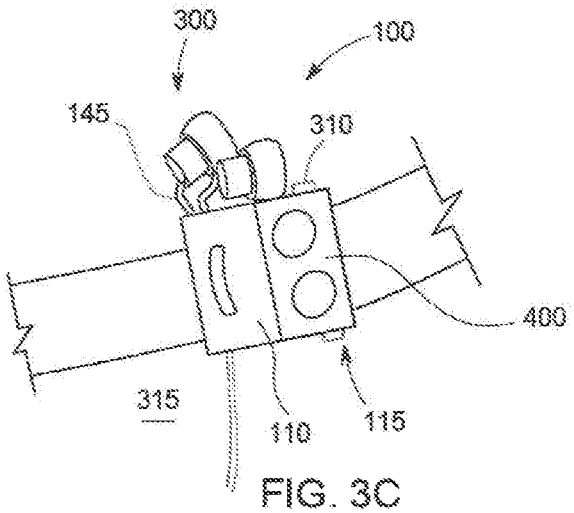
FIG. 3C is a schematic view of the earphone cable holder of FIG. 2 in another use.

FIGS. 3A, 3B, and 3C show the earphone cable holder 100 in different uses. In FIG. 3A, it can be seen that the earphone cable holder 100 can be used to allow the user to neatly wind and pack the earphone cable 145 around the earphone cable holder 100 without entanglement. The earphone cable 145 can be wound around the central portion 125 of the earphone cable holder 100 when in the open position and then the earphone cable holder can be folded to the folded position to secure the wound earphone cable 145 between the first end portion 115 and the second end portion 120. FIG. 3B shows the earphone cable holder 100 positioned on a shirt 160, such as a shirt placket, as in FIG. 1A. In FIG. 3B, it can be seen the earphone cable holder 100 can easily and readily hold the earphone cable 145 when the earphones are not in use. In this case, the ear pieces 300 have been removed from the user's ears, and the earphone cable 145 has been pulled down through the earphone cable holder 100 so that the earpieces 300 are retained are the top of the earphone cable holder 100. When the user wants to reinsert the earpieces 300 into his or her ears, the earpieces 300 are conveniently located and may be inserted by pulling on them and allowing the earphone cable 145 to slide within the earphone cable holder 100. FIG. 3C shows the earphone cable holder 100 clasped around a belt loop 310 of a pair of pants 315. The belt loop 310 can be positioned within the central portion 125 of the earphone cable holder 100, as shown, or can be positioned between the magnets 130, 135 in much the same way the shirt placket is in FIG. 3B.

The earphone cable holder 100 is made of materials and dimensions that allow it to accomplish the above functions. The earphone cable holder 100 is sufficiently flexible that it can be easily folded along its length. The earphone cable holder 100 is also sufficiently rigid that it can support the earphone cable 145 on a garment and can support the earphone cable 145 wound around the earphone cable holder 100. In one particular version, the earphone cable holder 100 is made of leather and has a length, L, of from about 2.5 inches to about 5.5 inches, more preferably from about 3.5 inches to about 4.5 inches, and most preferably about 4 inches. In this particular version, the earphone cable holder 100 has a width, W, of from about 0.5 inches to about 3.5 inches, more preferably from about 1.25 inches to about 2.0 inches, and most preferably about 1.75 inches. In this particular version, the earphone cable holder 100 has a thickness, T, of from about 0.125 inches to about 0.75 inches, more preferable from about 0.25 inches to about 0.625 inches, and most preferably about 0.375 inches. By "thickness" it is meant the thickness of the earphone cable holder 100 at its central portion 125 when the fold occurs. Alternatively, the earphone cable holder 100 may be composed of a material other than leather or may be composed of materials in combination with leather. As the mechanical properties of the selected materials change, the range of dimensions changes accordingly.

With particular reference to FIG. 3A, in one version of the invention the central portion 125 is composed of a material that is sized and dimensioned so that it is sufficiently wide and sufficiently rigid to allow an earphone cable 145 to be wound around it. In this regard, it is meant that the cable can be wound around the central portion 125 two or more times without significant deformation occurring to the central portion 125. In one version, the width of the central portion is at least 0.5 inches and the thickness is at least 0.125 inches. When a more rigid material is used, the thickness can be correspondingly less. In general, the earphone cable holder 100 according to this version of the invention should be able to support the wound earphone cable 145.

As also can be seen in FIGS. 3A, 3B, and 3C, the earphone cable holder 100 may also be equipped with a decorative member 400 on which a decorative or ornamental feature can be displayed. The decorative or ornamental feature may be, for example, jewelry elements, such as those shown in FIG. 3A; a thematic symbol, such as the holiday symbol like the face of Santa Claus in FIG. 3B; or the like.

By having a decorative member 400 on which a decorative or ornamental feature can be displayed, the earphone cable holder 100 can be personalized to a user's likes and preferences. As will be described, the decorative member may be easily removable and replaceable so a user may change the decorative member as often as the user likes. In this regard, a plurality of different decorative members may be provided.

Figure 4:
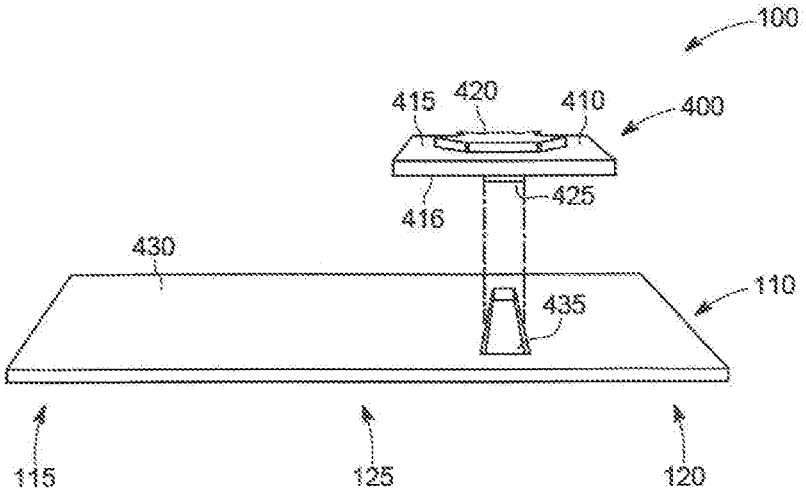
FIG. 4 is a schematic, exploded, perspective view of a version of an earphone cable holder with a structure on which a decorative or ornamental feature may be displayed.

In one version of the invention, the decorative member 400 of the earphone cable holder 100 on which a decorative or ornamental feature may be displayed is in the form of a slab 410 that may be magnetically held onto the earphone cable holder 100, as shown in FIG. 4. The slab 410 is a block of rigid or semi-rigid material having a front face 415 onto which a decorative or ornamental feature 420 can be attached. The slab 410 may be rectangular or any other geometric shape, such as square, circle, oval, or star, or may be any ornamental shape, such as in the shape of a design, animal, flower, symbol, or the like. On the back side 416 of the slab 410 is a plinth 425 or projection. Also shown in FIG. 4 is the outer surface 430 of the base 110 of the earphone cable holder 100. The outer surface 430 is the side of the base 110 opposite to the side that includes the cable connecting mechanism 150. On the outer surface 430, at either the first end portion 115 or the second end portion or both, is provided a recess 435 that is shaped to receive the plinth 425 on the slab 410. The plinth 425 may be inserted into the recess 435 so that the slab 410 may be installed onto the earphone cable holder 100 easily and easily removed therefrom. The slab 410 or a portion of the slab 410 is made of a ferromagnetic material so that the slab is attracted to the magnet 135 in the second end portion 120 (or magnet 130 if a recess is provided in the first end portion 115). The magnetic attraction of the magnet 135 and the ferromagnetic material secures the plinth 425 within the recess 435. In one version, the ferromagnet material is a sheet of ferromagnetic metal on the back side 416 of the slab 410 and has a layer of leather or similar material on the face 415. In another version, a sheet of ferromagnetic material is sandwiched between a leather layer on the backside 416 of the slab 410 and a leather layer on the fact 415 of the slab 410. In another version, the slab 410 may have multiple plinths 425 that are received within multiple corresponding recesses on the outer surface 430 of the base 110.

Figure 5A:
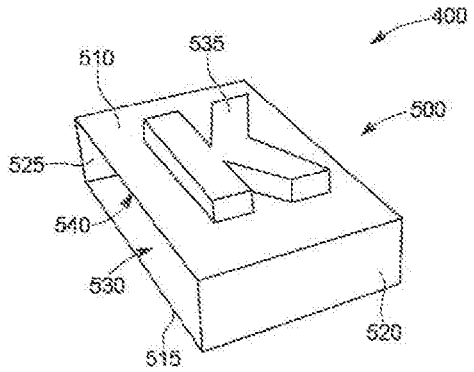
FIG. 5A is a schematic perspective view of another version of a structure on which a decorative or ornamental feature may be displayed.

In another version of the invention, the decorative member 400 of the earphone cable holder 100 on which a decorative or ornamental feature may be displayed is in the form of a band 500 that may be slid onto and magnetically held onto the earphone cable holder 100, as shown in FIG. 5A. The band 500 is box-shaped with four sides, a top face 510, a bottom face 515, and two side walls 520, 525. The four walls create a hollow interior space 530. The hollow interior space 530 is sized and shaped to be received over the first end portion 115 and/or the second end portion 120 of the base 110 of the earphone cable holder 100. On the top face 510 is a decorative or ornamental feature 535. The band 500 can be made of flexible, semi-rigid, or rigid material. For example, the band 500 walls may comprise one or more of leather, a synthetic material, fabric, such as synthetic fabric, velvet, denim, cotton, and the like. The materials may be transparent or may display various colors, carvings, embroidery, and the like. On the lower surface 540 of the upper top face wall 510 may be affixed a thin ferromagnetic material. When the band 500 is installed over the first end portion 115, the ferromagnetic material is attracted to the first magnet 130, and the band is thereby held in place. In another version, the hollow interior space 530 is sized and shaped to receive both the first end portion 115 and the second end portion 120 when the earphone cable holder 100 is in the folded configuration.

Figure 5B:
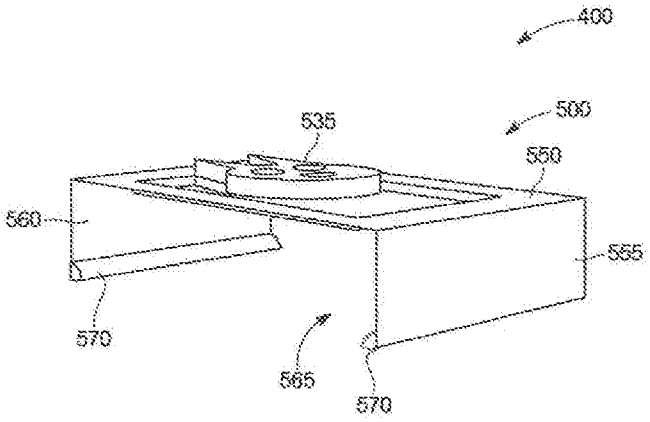
FIG. 5B is a schematic perspective view of another version of a structure on which a decorative or ornamental feature may be displayed.

Another version of a band 500 is shown in FIG. 5B. The band 500 of FIG. 5B has three walls, a top face 550 and two side walls 555, 560. The three walls define an interior space 565 that is sized and shaped to be received over the first end portion 115 and/or second end portion 120 of the base 110. On the top face 550 is a decorative or ornamental feature 535 as described above. In this version, the lower wall is removed and replaced with smaller clasp elements 570 that engage the interior surface of the first end portion to help secure the band thereto. The band 500 may also include a ferromagnetic material on the lower surface of the top face 550, as discussed above in connection with the FIG. 5A version.

In another version of the invention, the decorative member 400 of the earphone cable holder 100 on which a decorative or ornamental feature may be displayed is in the form of a band 500 made of flexible material, such as leather, a synthetic material, fabric, such as synthetic fabric, velvet, denim, cotton, and the like. The materials may be transparent or may display various colors, carvings, embroidery, and the like, and may carry a decorative element such as jewelry. The extremities of the band 500 in this version are joined together to form a closed belt that can be placed around one or more of the extremities of the base 110.

The earphone cable holder 100 of the present invention can also be used in manner not described above. For example, the earphone cable holder 100 can be used as a money clip instead of or in addition to an apparel clasp. Alternatively, the clasping function of the folded earphone cable holder 100 can be used to hold other items, such as notes or envelopes. In yet another version, the holder 100 can be used to hold cables or wires other than earphone cables.

The decorative member 400 on which a decorative or ornamental feature can be displayed may display, on its outer surface, any design or carving or colors. It may also have affixed to it a jewelry element made of precious metals and/or precious stones or faux bijoux, or decorative elements representing animals or flowers, flags, logos, symbols, such as civil, military, religious, or other symbols, celebratory symbols for holidays including Halloween, Christmas, Saint Valentin, Saint Patrick's Day, Memorial Day, or other occasions, or words and letters and names, or the like. Such decorative elements may also be created as elements provided with a small battery and lights, including glowing, static or changing colors, and the like. The decorative element may be immovable or may have some degree of mobility to change its axes on the band in order to adjust to the position wished by the user, or it may be entirely detachable from the decorative member 400, so that it may be removed and/or replaced.

Although the present invention has been described in considerable detail with regard to certain preferred versions thereof, other versions are possible, and alterations, permutations and equivalents of the version shown will become apparent to those skilled in the art upon a reading of the specification and study of the drawings. For example, the cooperating components may be reversed or provided in additional or fewer number. Also, the various features of the versions herein can be combined in various ways to provide additional versions of the present invention. Furthermore, certain terminology has been used for the purposes of descriptive clarity, and not to limit the present invention. Therefore, any appended claims should not be limited to the description of the preferred versions contained herein and should include all such alterations, permutations, and equivalents as fall within the true spirit and scope of the present invention.

What is claimed is:

1. An earphone cable holder comprising:

a base having a first end portion, a second end portion, and a central portion, wherein the central portion is sufficiently flexible that the first end portion can be folded over the second end portion by a single fold and wherein the central portion is sufficiently wide and sufficiently rigid to allow an earphone cable to be wound around it;

a magnet on the first end portion;

a material on the second end portion that is attracted to the magnet;

a cable connecting mechanism on the central portion; and a material on the central portion that exerts a grabbing effect on a cable passing through the central portion when the first end portion is folded over the second end portion;

wherein an earphone cable may be connected to the cable connecting mechanism and wherein the first end portion and the second end portion may clasp onto a material positioned therebetween by magnetic attraction.

2. An earphone cable holder according to claim 1 wherein the material on the second end portion is a second magnet of opposite polarity than the magnet on the first end portion.

3. An earphone cable holder according to claim 1 wherein the cable connection mechanism comprises an elastic strip or cord.

4. An earphone cable holder according to claim 1 wherein the base comprises leather.

5. An earphone cable holder according to claim 1 wherein the first end portion comprises a protuberance, wherein the second end portion comprises a depression, and wherein the protuberance is receivable in the depression when the first end portion is folded over the second end portion.

6. An earphone cable holder according to claim 1 further comprising a decorative member on which a decorative feature can be displayed, the decorative member being selectively attachable to the earphone cable holder.

7. An earphone cable holder according to claim 1 wherein the magnet comprises a plurality of magnets.

8. An earphone cable holder comprising:

a base having a first end portion, a second end portion, and a central portion, wherein the central portion is sufficiently flexible that the first end portion can be folded over the second end portion;

a magnet on the first end portion;

a material on the second end portion that is attracted to the magnet; and a material on the central portion that exerts a grabbing effect on a cable passing through the central portion when the first end portion is folded over the second end portion;

wherein an earphone cable may be received within the central portion and wherein the first end portion and the second end portion may clasp onto a material positioned therebetween by magnetic attraction.

9. An earphone cable holder according to claim 8 wherein the material on the central portion applies sufficient pressure to the earphone cable when the first end portion is folded over the second end portion to hold the earphone cable in place by friction and/or compression and wherein the grabbing effect is sufficient to counteract the force of gravity and to keep the earphone cable in place against the force of gravity.

10. An earphone cable holder according to claim 8 wherein the material on the central portion comprises one or more of a furry, plushy, shaggy, fleecy, wooly or fluffy texture, and synthetic fluffy fabric.

11. An earphone cable holder according to claim 10 wherein the material on the central portion comprises real or fake fur or sheep skin.

12. A method of holding an earphone cable, the method comprising:

providing a base having a first end portion, a second end portion, and a central portion;

connecting an earphone cable to the central portion;

winding the earphone cable around the central portion;

folding the first end portion over the second end portion by flexing the central portion; and clasping onto a material positioned between the first end portion and the second end portion by magnetic attraction, wherein the central portion comprises a material on the central portion that exerts a grabbing effect on a cable passing through the central portion when the first end portion is folded over the second end portion.

13. A method according to claim 12 wherein the central portion is flexed at a single fold.

14. A method according to claim 12 further comprising attaching to the base a decorative member on which a decorative feature can be displayed.

* * * * *